US005114085A

United States Patent [19]

Inui

[11] Patent Number: 5,114,085

[45] Date of Patent: May 19, 1992

[54] HAMMER FOR USE IN HAMMER MILL

[75] Inventor: Yasuo Inui, Osaka, Japan

[73] Assignee: Kurimoto Ltd., Osaka, Japan

[21] Appl. No.: 724,502

[22] Filed: Jun. 28, 1991

Related U.S. Application Data

[63] Continuation of Ser. No. 555,597, Jul. 23, 1990, abandoned.

[30] Foreign Application Priority Data

Apr. 19, 1990 [JP] Japan ..... 2-103683

[51] Int. Cl.[5] ..... B02C 13/28

[52] U.S. Cl. ..... 241/195; 241/197

[58] Field of Search ..... 241/194, 195, 197

[56] References Cited

U.S. PATENT DOCUMENTS 2,663,505 12/1953 Sennholtz ..... 241/197

*Primary Examiner*—Joseph M. Gorski

*Attorney, Agent, or Firm*—Jones, Tullar & Cooper

[57] ABSTRACT

The present invention relates to a hammer for use in a hammer mill and particularly provides an improved hammer of separate type in which a hammer head is detachably coupled with a hammer body. A material of the highest level in abrasion resistance such as high chromium cast iron is employed to form the hammer head. In spite of brittleness of the material, there is no such problem as breakdown due to impulse forces applied and transferred immediately because there is no looseness at all in the engagement of the coupled hammer body and hammer head. Energy applied is sufficiently utilized thereby improving energy efficiency.

4 Claims, 5 Drawing Sheets

FIG. 2(C)
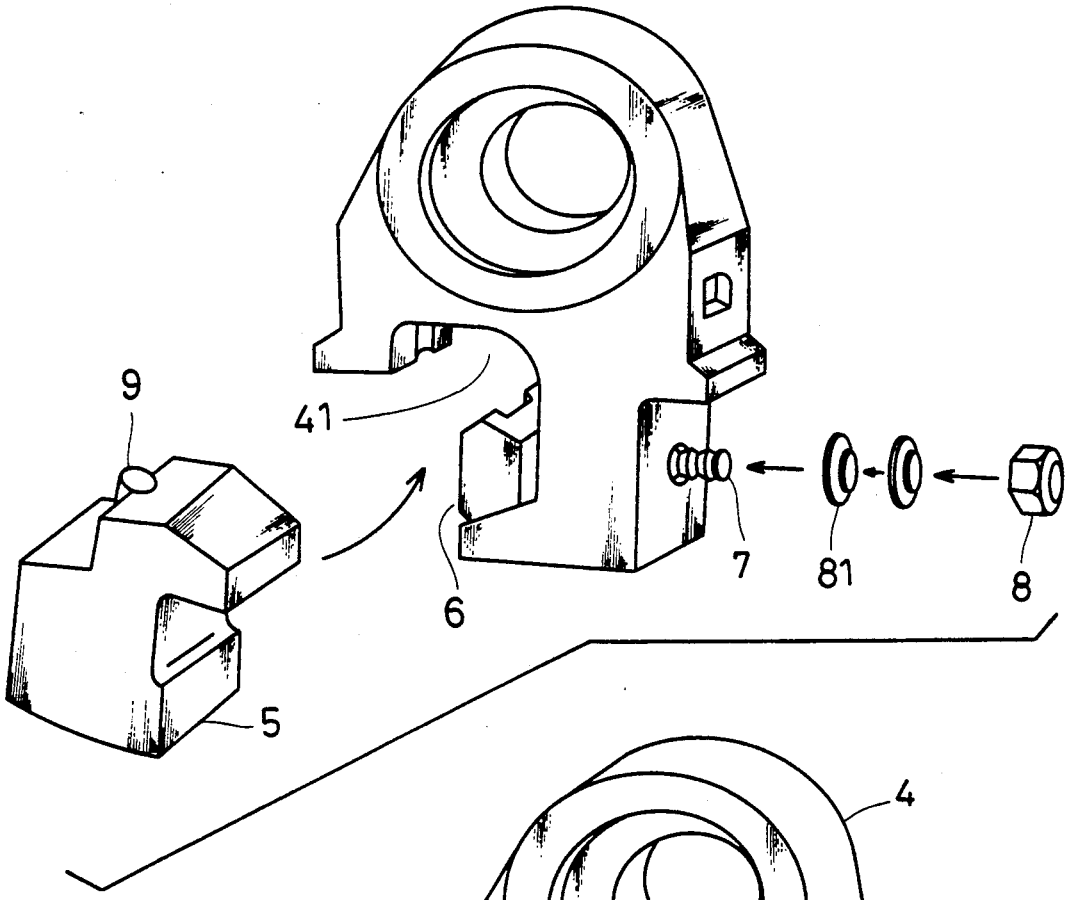
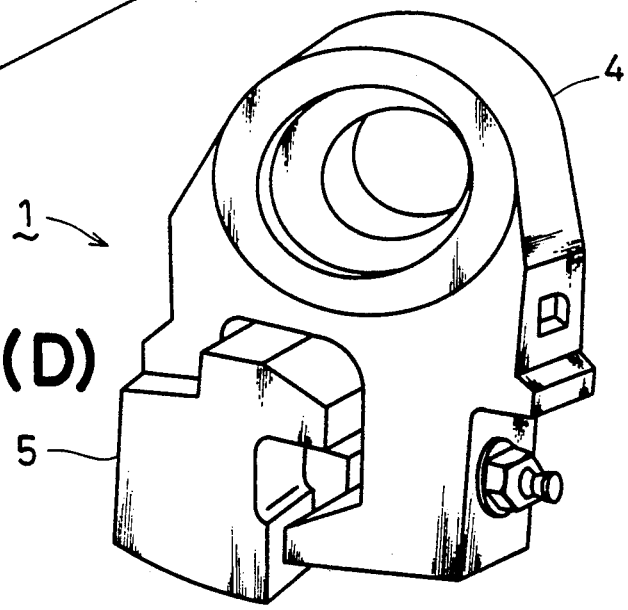
FIG. 2(D)

HAMMER FOR USE IN HAMMER MILL

This is a continuation of co-pending U.S. application Ser. No. 07/555,597 filed on Jul. 23, 1990 and now abandoned.

BACKGROUND OF THE INVENTION

1. Field of the Invention

The present invention relates to a hammer for use in a hammer mill which is popularly employed in such industrial fields as cement, iron steel, ceramics or thermal power generation.

2. Description of the Prior Arts

Generally in conventional hammer mills, a large number of hammer disks 2*a* are mounted on a rotary shaft (not illustrated) rotating at high speed (about 400 rpm), and a large number of hammers 1*a* are oscillatably suspended each from between one hammer disk and another as shown in FIG. 3. The hammers 1*a* are rotated at high speed along the inner wall of the container according to the rotation of the rotary shaft. Objects to be crushed are fed into the container collide with the front face of each hammer 1*a* and are crushed by an impulsive force. As a result, the hammer receives a reaction force and rotates around the hammer shaft in the opposite direction so as to prevent itself from breakdown due to excessive impulse.

In this regard, it is a matter of course that the front face directly colliding with the object to be crushed is exposed to such severe conditions that it suffers from strong and considerable impulsive abrasion, so that the life of the front face material is rather short even though a high abrasion resistant material is employed.

To meet the situation, several attempts have been proposed, wherein a hammer is divided into a hammer body and a hammer head so that only the hammer head is replaced when the hammer head is worn out while leaving the hammer body as it is on the shaft.

In a hammer of this type, it is an essential requirement that the replacement of the worn hammer head with a new one should be easily and speedily performed so that interruption in the operation of the hammer mill may be as short as possible. It is also essentially important that the energy applied is not wasted due to looseness between the hammer body and the hammer head.

Referring briefly to the known techniques in the art, Japanese Patent Publication (examinined) No. 42-7234 discloses, as shown in FIG. 4, that replacement of the hammer head is easily performed by providing convex and concave portions slidably engaging with each other in vertical and horizontal directions, and that impulse received by the hammer head 5*a* at the front end may be absorbed by the turning movement of the hammer body 4*b* through the engaged portion.

Japanese Utility Model Registration Publication (examined) No. 48-40196 discloses, as shown in FIG. 5, a combination between the hammer body 4*c* and the hammer head 5*c* based on substantially the same techincal idea as that noted in the previously mentioned patent publication.

Japanese Patent Publication (examined) No. 44-4568 discloses, as shown in FIG. 6, that the hammer head 5*d* engages with the hammer body 4*d* in such a manner as to hold the extending part of the hammer body 4*d*, then a pin is inserted therethrough and two ends of the pin are welded in such a manner as to secure free oscillation between the hammer body and the hammer head. Thus, impulse forces may be absorbed by the turning movement of the hammer head.

Japanese Patent Publication (examined) No. 45-40632 discloses, as shown in FIG. 7, that to overcome the disadvantage of partial absorption of the driving force due to looseness in the joint between the hammer body 4*e* and the hammer head 5*e* of the conventional hammer of the engagement type, the looseness bringing about reduction in driving efficiency, a cutout portion and a tongue piece are provided to be securely coupled with each other so as to receive impulses evenly on the curved surface where the hammer body 4*e* and the hammer head 5*e* contact.

It is certain that so long as an integral solid hammer is to be manufactured, the hammer is popularly made of a tough material such as high manganese cast steel. But in the hammer construction which is divided into a hammer body and a hammer head to renew the hammer head alone, there is room for combination of the hammer body and the hammer head each being separately manufactured of different materials.

In manufacturing such a hammer, durability against abrasion may be prolonged several times over the known hammer by manufacturing the hammer head of a material (such as high chromium cast iron) which is more abrasion resistant than that of the hammer body. As is well known, however, high chromium cast iron is not as resitant to impulses and, therefore, there is a possibility of a reduced service life due to breakdown rather than abrasion. As a result, such a hammer comprising a hammer head of high chromium cast iron combined with a hammer body with a similar engagement as the conventional hammer is not suitable for practical use.

For example, backlash or looseness can be seen in the prior art shown in FIGS. 3 and 4 at the engaged part between the hammer head and the mammer body and, moreover, there is a neck part on which load is concentrated in the engaged part. Accordingly, a so-called notch effect takes place in the neck, which means that the mentioned manner of engagement is not suitable for brittle material, either.

In the combination shown in FIG. 5, the hammer head and the hammer body are coupled with each other to be freely oscillatable through a common pin, and impulse is avoided by turning of the two members themselves. However, since every impulse load is imposed directly on the hammer head alone, there still remains concern when using a brittle material.

In the combination shown in FIG. 6, an optimum curved surface at a joint is disclosed to solve the problem of energy loss due to looseness in the coupled part. It is, however, probable that the larger the curved surface area is, the more the possibility of error in the mutually engaged surfaces, and even a small looseness brings about a concentration of an impulse load on a specific part in a complicated way. Such an undesirable result is unavoidable as long as the engaging members are cast products.

In effect, there exists a problem in the state of the art that any of the high abrasion resistant materials (all of them are poor in their resistance to impulse) cannot be adopted in a hammer mill because of the mentioned high possibility of notch, cleavage, cutting or the like.

SUMMARY OF THE INVENTION

The present invention solves the above-discussed problem and has as an object providing a separate type hammer for use in a hammer mill in which the hammer head is of high abrasion resistant material such as high chromium cast iron and can be adopted in a novel engagement manner.

In order to accomplish the foregoing object, the hammer for use in a hammer mill in accordacne with the invention comprises: a hammer body in which an almost square recess facing toward the direction of rotation of the hammer mill is provided at a lower portion of the hammer body, with a bottom part of the recess being formed into an extending part in such a manner as to have a flat front end face facing toward the direction of rotation and with an inclined top face, and an upper part of the recess being formed into another extending part in such a manner as to have a flat end face facing in opposite direction from the front end face; a hammer head which is engagedly inserted in said the recess, the hammer having two corresponding flat faces to be in close contact with the two flat faces of the extending parts of the and an inclined surface corresponding to the inclined top face of the bottom extending part; and a cotter which is disposed to engage with both of inclined faces, and through which the hammer body and the hammer head are screwed for engagement with each other.

It is preferable that the two faces of the hammer body and the hammer head which are to be in close contact with each other are machined to have a smooth finish.

In the hammer of the above construction, the lower part of the front end of the hammer head serves as a crushing member which is rotated at high speed and collides strongly with objects fed into the mill to be crushed, such as ores and rocks.

A large impulse force generated in the mentioned operation is mainly used as energy for crushing the object to be crushed, and a part of the force is diffused in the form of energy received by the hammer as a reaction force. In the conventional hammer, however, even if the hammer is made of a high abrasion resistant material, the hammer cannot endure the reaction force and breaks down in a rather short period berfore exhibiting high abrasion resistance of the material.

On the other hand, in the construction according to the invention, since a close contact surface is formed between the mentioned flat face of the hammer body and that of the hammer head in both the upper and bottom parts, the large reaction force applied to the crushing portion of the hammer head immediately acts on the hammer body as a turning force through the two contact surfaces thereby absorbing the impulse. As a result, a function is performed such that the brittleness of the hammer head is protected resulting in prevention of hammer breakdown.

In the hammer according to the invention, since the highest abrasion resistant metal material such as high chromium cast iron is adopted, to form the hammer, the possibility of breakdown, cleavage or the like is largely reduced and the abrasion resistance is satisfactorily exhibited for prolonging the life of the hammer.

Furthermore, since there is no looseness at the engaged part between the hammer head and the hammer body, the energy applied is not wasted thereby contributing to improvement in energy efficiency.

As a result, the invention is effective for improvement in the operation rate of the hammer mill and for reduction in both the working and maintenance costs.

Other objects and advantages of the invention will become apparent in the course of the following description with reference to the accompanying drawings.

BRIEF DESCRIPTION OF THE DRAWINGS

In the drawings forming a part of the present applicatiion.

DESCRIPTION OF THE PREFERRED EMBODIMENT

Figure 1B:
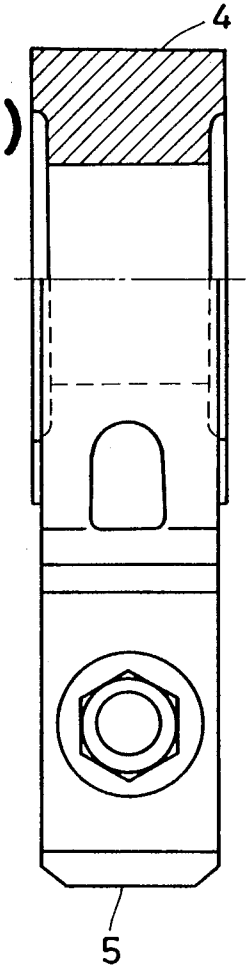
FIGS. 1 A and B are respectively a vertical sectional view and a side view of an embodiment in accordance with the present invention.
Figure 1A:
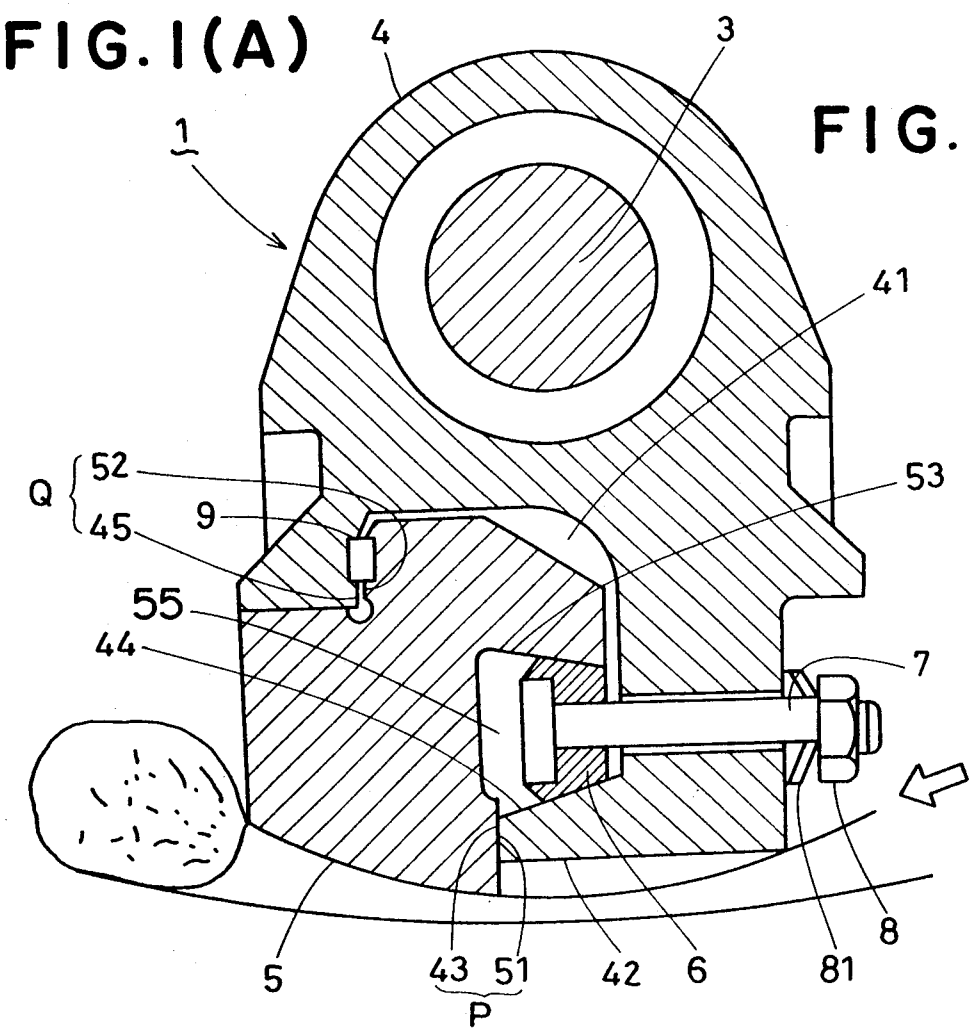
Figure 2A:
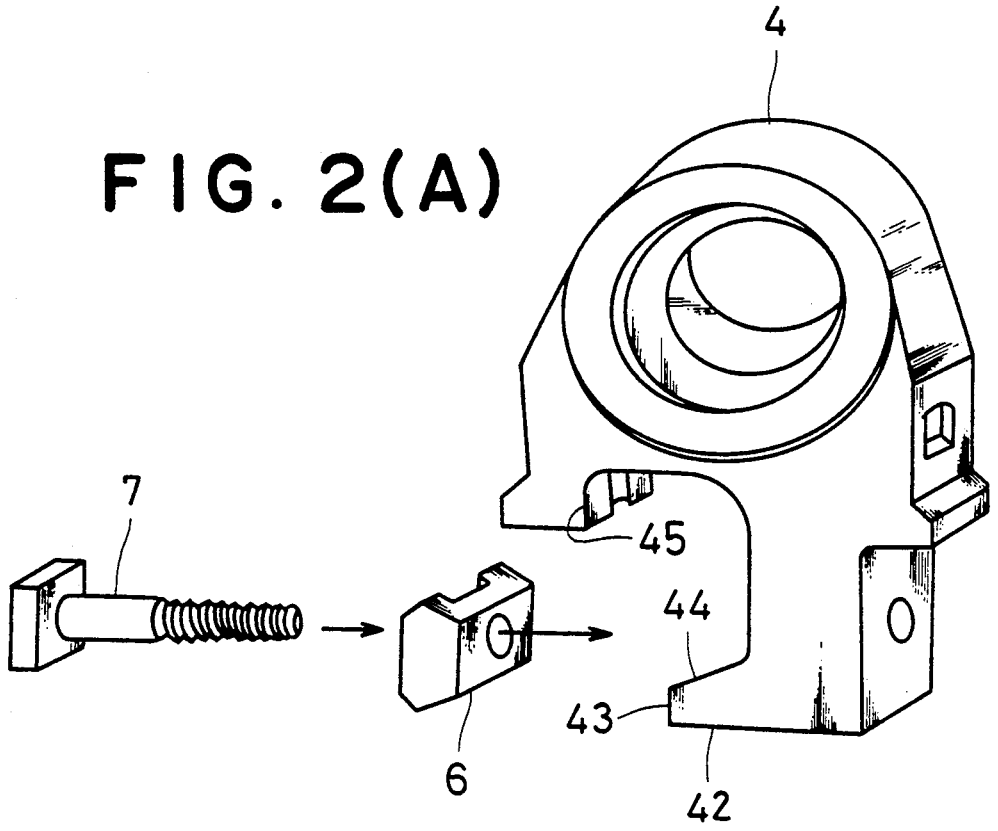
FIGS. 2 A, B, C and D are respectively perspective views to explain the assembling process.
Figure 2B:
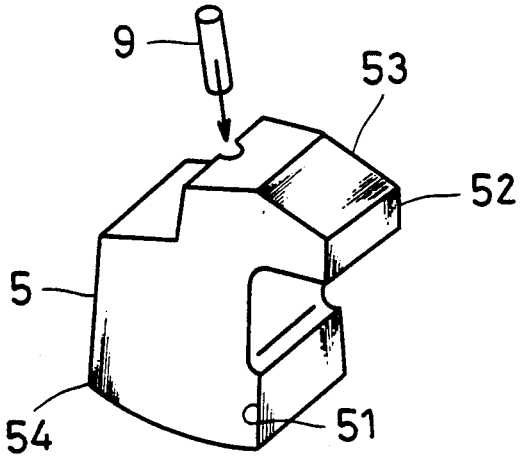
Figure 3:
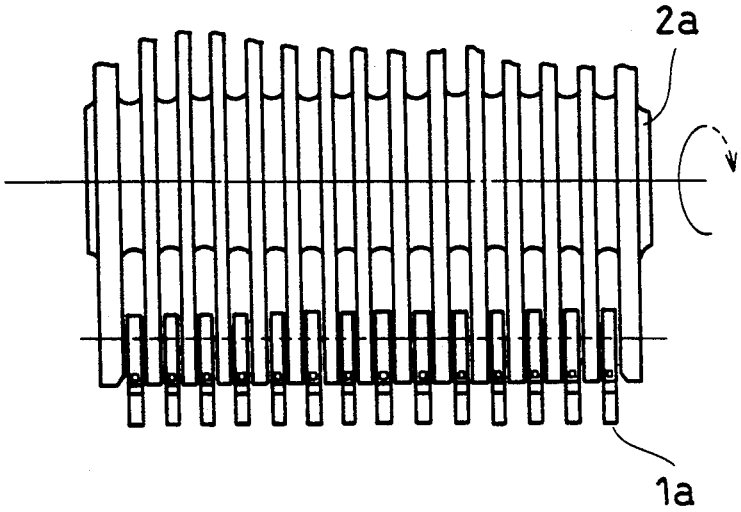
FIG. 3 is a front view of the hammer mill in accordance with a prior art.
Figure 4:
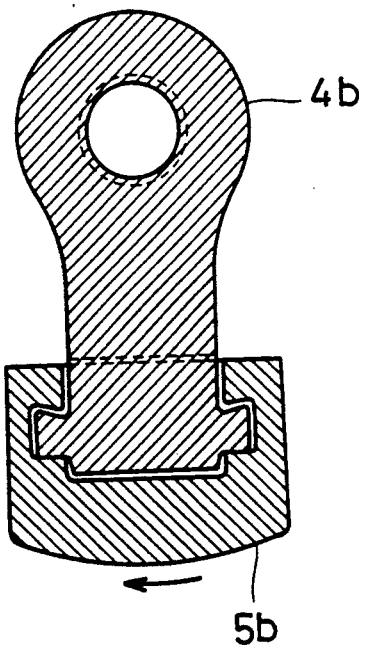
Fig. 4 Prior Art
FIGS. 4 and 5 are respectively vertical sectional views of different prior arts.
Figure 5:
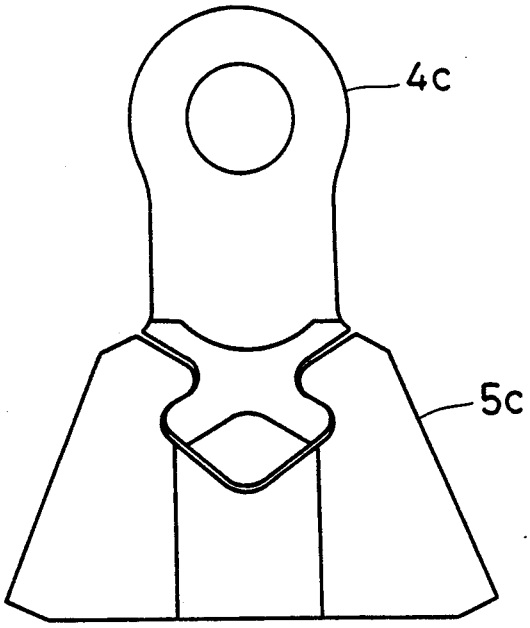
Fig. 5 Prior Art
Figure 6A:
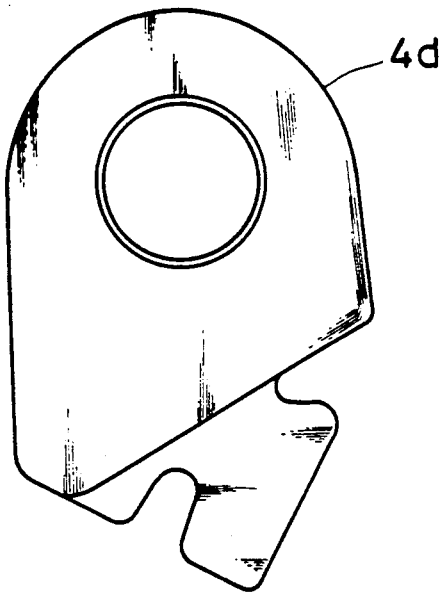
FIG. 6(A) Prior Art
FIGS. 6 A and B are front views of further prior art.
Figure 6B:
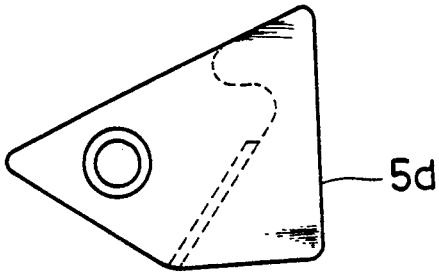
FIG. 6(B) Prior Art
Figure 7:
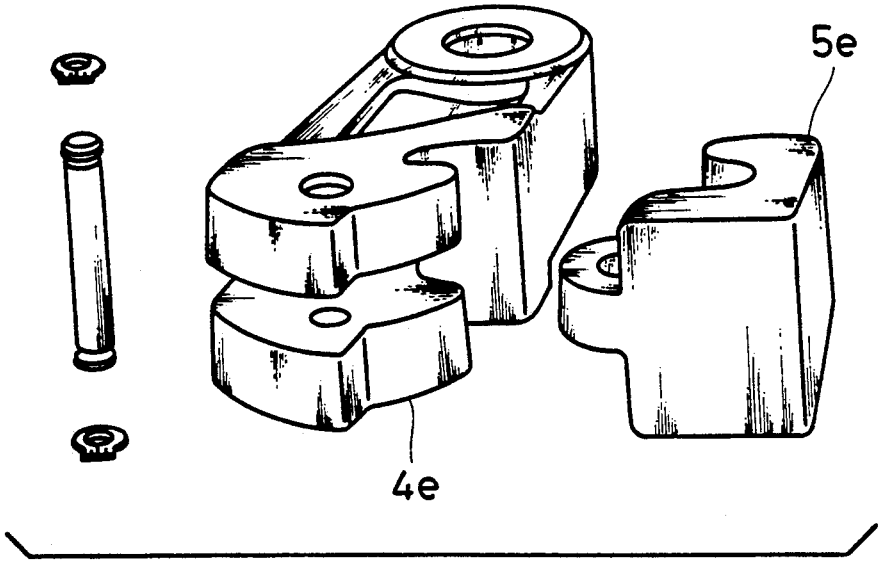
Fig. 7 Prior Art
FIG. 7 is an exploded perspective view of a yet further prior art.

FIGS. 1 A and B respectively show a vertical sectional view and a side view of a hammer embodied in accordance with the present invention, and FIGS. 2 A, B, C and D show the process of assembling the hammer body and the hammer head into a solid unit hammer.

The hammer 1 is formed by combining the hammer body 4 pivoted by the hammer shaft 3 commmon in every hammer disk *2a* with the hammer head 5.

In the hammer body 4, an, almost square recess 41 is provided at the lower part of the hammer body 4 so as to face toward the direction of rotation of the hammer disk. An extending part 42 (lower extending part) is provided so as to extend forward from the bottom part of the recess. A smooth face 43 facing toward the direction of rotation (indicated by the arrow) is provided on the front end of the extending part 42. The upper face 44 of the extending part extends rearwardly from the end face 43 is inclined. Another face 45 is provided on another extending part (upper extending part) located at a diagonal position from the extending part 42 in the opposite direction from the face 43.

The hammer head 5 to be engagedly inserted in the recess 41 has a flat face 51 to be in close contact with the flat face 43 and another flat face 52 to be in close contact with the flat face 45. The hammer head 5 is also provided with an inclined surface 53 which corresponds to the inclined surface 44. A cotter 6 is disposed between the two inclined surfaces 44 and 53, and the hammer head and the hammer body are fixedly screwed for engagement by means of a T bolt 7 and a nut 8. In actual assembly, it is preferable that a disc spring washer 81 is placed between the nut 8 and the hammer body 4 so as to protect the engagement by means of the bolt and nut.

The lower extending part 42 and the hammer head 5 define a notch 55 within the recess 41, within which the cotter 6 is located.

Further in practical use, a pin 9 is disposed for retention at the boundary between the hammer body and the hammer head to prevent them from being laterally sheared (i.e., in the direction perpendicular to the drawing).

With regard to the process for coupling the hammer body and the hammer head, as illustrated in FIGS. 2 A, B, C and D in order, first the cotter 6 is placed in the hammer body 4 so as to be freely movable (FIG. 2 A), while the pin 9 is vertically inserted in the hammer head (FIG. 2 B), then the hammer head is twistingly inserted from outside obliquely in the recess 41 of the hammer body, and finally the nut 8 is placed on the top end of the T bolt through interposition of the disc spring to be securely screwed for engagement.

The front end lower portion of the hammer head 5 serves as a crushing member 54, and objects fed into the mill collide forcibly with this crushing member 54 rotating at high speed. At this time, a large impulsive force is generated. However, since a close contact engagement P (FIG. 1A) is formed between the flat face 43 of the hammer body and the flat face 51 of the hammer head as well as a close contact engagement Q (FIG. 1A) between the flat face 45 and the flat face 52 in the construction according to the invention, which is different from the prior art, the large reaction force applied to the crushing member 54 of the hammer head immediately acts to turn the hammer body 4 through the two contact engagements P and Q thereby absorbing the impulse. As a result, a peculiar function is exhibited such that brittleness of the hammer head is protected resulting in breakdown prevention of the hammer.

With regard to characteristics of the material which performs the foregoing function, it has been generally said that high chromium cast iron (27% chromium cast iron, for example) is poor in resistance to impulse loads and high in brittleness. It has been, however, acknowledged that the compressive strength of the surface of this material is rather high to the extent of exhibiting satisfactory resistance or endurance under the condition of contact between smooth flat faces.

The foregoing characterisctic is assured just on the condition that two members are fully in close contact and apply compressive force to each other. Accordingly, it may be difficult to satisfy this condition on the contact between ordinary as cast surfaces without a very careful manual finish with gauge. It is, therefore, preferable that the mentioned flat faces to be in contact with each other are fully finished by suitable machning so as to be even at every contact surface. Such a finish by machining is recommendable as a useful means particularly in mass production.

In the machine finishing of highly hard material such as the 27% chromium cast iron, however, cutting with conventional tips may unavoidably achieve low efficiency resulting in increased costs. From this point of view, it is preferable to adopt some specific machining such as electric discharge machining.

Having described so far the present invention as related to the embodiment shown in the accompanying drawing, it is our intention that the invention is not limited by any of the details of the foregoing description, unless otherwise specified, but rather is constructed broadly within the spirit and scope as set force in the appended claims.

What is claimed is:

1. A hammer for use in a hammer mill, comprising:

a hammer body having a substantially square recess formed therein defining front and side openings, said hammer having an upper extending part and a lower extending part which together partly define said recess, each extending part having at least one hammer head engaging surface;

a hammer head received within said recess, such that said hammer head completely closes the front opening of said recess, said hammer head having corresponding surfaces which engage a respective one of the hammer head engaging surfaces of each extending part, said hammer head and the lower extending part of said hammer body defining a notch in said recess defining side openings which coincide with the side openings of said recess, with the lower extending part and said hammer head each defining an inclined surface located in said notch; and retaining means including a cotter received within said notch and engageable with the inclined surface of said hammer head and the inclined surface of the lower extending part of said hammer body for retaining said hammer head in engagement with said hammer body in said recess.

2. The hammer as defined in claim 1, wherein the engaged surfaces of said hammer body and said hammer head are provided with a smooth finish.

3. The hammer as defined in claim 1, wherein said notch forms an internal insert.

4. The hammer as defined in claim 1, wherein said hammer head defines an extending part, and wherein the extending part of said hammer head and the lower extending part of said hammer body are spaced apart and define an upper and lower limit of said notch when said hammer body is received within said recess.

* * * * *